US007591774B1

(12) United States Patent
Tien

(10) Patent No.: US 7,591,774 B1
(45) Date of Patent: Sep. 22, 2009

(54) WAIST TWISTER WITH SWAYING FUNCTION AND HEAT RADIATING EFFECT

(75) Inventor: Feng-Yi Tien, Chia Yi (TW)

(73) Assignee: ACAS Design Co., Ltd., Chia Yi (TW)

( * ) Notice: Subject to any disclaimer, the term of this patent is extended or adjusted under 35 U.S.C. 154(b) by 0 days.

(21) Appl. No.: 12/193,954

(22) Filed: Aug. 19, 2008

(51) Int. Cl.
*A63B 22/14* (2006.01)

(52) U.S. Cl. ..... 482/147; 482/146

(58) Field of Classification Search ..... 482/34, 482/146–147
See application file for complete search history.

(56) References Cited

U.S. PATENT DOCUMENTS 1,533,500 A * 4/1925 Hovda ..... 434/302
2,256,001 A * 9/1941 Titus ..... 482/147
2,351,293 A * 6/1944 Saunders ..... 482/147
3,100,639 A * 8/1963 Bonewitz ..... 482/147
4,291,873 A * 9/1981 Lee et al. ..... 482/147
4,629,181 A * 12/1986 Krive ..... 482/71
4,829,612 A * 5/1989 Adams ..... 5/81.1 RP
5,256,127 A * 10/1993 Yeh ..... 482/146
5,284,461 A * 2/1994 Wilkinson et al. ..... 482/53
5,683,337 A * 11/1997 Zetocha et al. ..... 482/146
5,695,439 A * 12/1997 Lin ..... 482/146
7,191,477 B2 * 3/2007 Hahn et al. ..... 5/81.1 RP
7,232,405 B2 * 6/2007 Ko ..... 482/146
7,438,675 B2 * 10/2008 Lin ..... 482/140
2002/0177511 A1 * 11/2002 Jang ..... 482/146
2003/0195096 A1 * 10/2003 Hecox et al. ..... 482/147
2004/0097343 A1 * 5/2004 Chen ..... 482/79
2005/0043143 A1 * 2/2005 Chuang ..... 482/51
2005/0148450 A1 * 7/2005 Huang ..... 482/147
2005/0209073 A1 * 9/2005 Chen ..... 482/146
2007/0027009 A1 * 2/2007 Arnold ..... 482/146
2007/0270296 A1 * 11/2007 Caldicott ..... 482/146
2008/0280740 A1 * 11/2008 Knecht et al. ..... 482/146
2008/0280741 A1 * 11/2008 Baek ..... 482/146

* cited by examiner

*Primary Examiner*—Lori Amerson
(74) *Attorney, Agent, or Firm*—Alan Kamrath; Kamrath & Associates PA

(57) ABSTRACT

A waist twister includes a base disk, a rotation disk rotatably mounted on the base disk, a top disk secured on the rotation disk, a drive motor secured on the top disk and having an impeller, and a top cover secured on the top disk to cover the impeller. Thus, the impeller has an unevenly distributed weight on the drive motor, so that when the drive motor is operated to rotate the impeller, the drive motor produces a vibration to vibrate the top disk, the rotation disk and the base disk to provide a swaying function to the user standing on the top disk. In addition, the top cover has ventilating holes to introduce the air flow produced by the impeller to flow outwardly to provide a heat dissipation effect to the user.

19 Claims, 6 Drawing Sheets

WAIST TWISTER WITH SWAYING FUNCTION AND HEAT RADIATING EFFECT

BACKGROUND OF THE INVENTION

1. Field of the Invention

The present invention relates to an exercising machine and, more particularly, to a waist twister to provide an exercising effect to a user.

2. Description of the Related Art

A conventional waist twister comprises a base disk and a rotation disk rotatably mounted on the top of the base disk. Thus, a user can stand on the rotation disk to exert a rotating force on the rotation disk to rotate the rotation disk relative to the base disk rightward and leftward so that the user's body can be swung and twisted so as to exercise the user's body. However, the user can only drive the rotation disk to rotate relative to the base disk, so that the exercising action is tedious and boring, thereby limiting the exercising effect of the waist twister. In addition, the waist twister cannot provide a heat radiating effect to the user, thereby easily causing an uncomfortable sensation to the user.

BRIEF SUMMARY OF THE INVENTION

In accordance with the present invention, there is provided a waist twister, comprising a base disk, a rotation disk rotatably mounted on a top of the base disk, a top disk secured on a top of the rotation disk to rotate in concert with the rotation disk, a drive motor secured on the top disk to rotate in concert with the top disk and having a top provided with an impeller which has an unevenly distributed weight on the drive motor, and a top cover secured on a top of the top disk to cover the drive motor and the impeller.

The primary objective of the present invention is to provide a waist twister that has a swaying function and can provide a heat radiating effect.

Another objective of the present invention is to provide a waist twister, wherein the impeller has an unevenly distributed weight on the drive motor, so that when the drive motor is operated to rotate the impeller, the drive motor produces a vibration to vibrate the top disk, the rotation disk and the base disk simultaneously so as to provide a swaying function to the user standing on the top disk, thereby enhancing the exercising effect of the waist twister.

A further objective of the present invention is to provide a waist twister, wherein the top cover has a plurality of ventilating holes connected to the impeller of the drive motor to introduce the air flow produced by the impeller of the drive motor to flow outwardly from the top cover and the top disk so as to provide a heat dissipation effect to the user standing on the top disk, thereby providing a comfortable sensation to the user.

A further objective of the present invention is to provide a waist twister, wherein each of the support pads is made of a soft material to isolate the base disk from the ground so that the vibration produced by the drive motor is limited to the top disk, the rotation disk and the base disk only.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
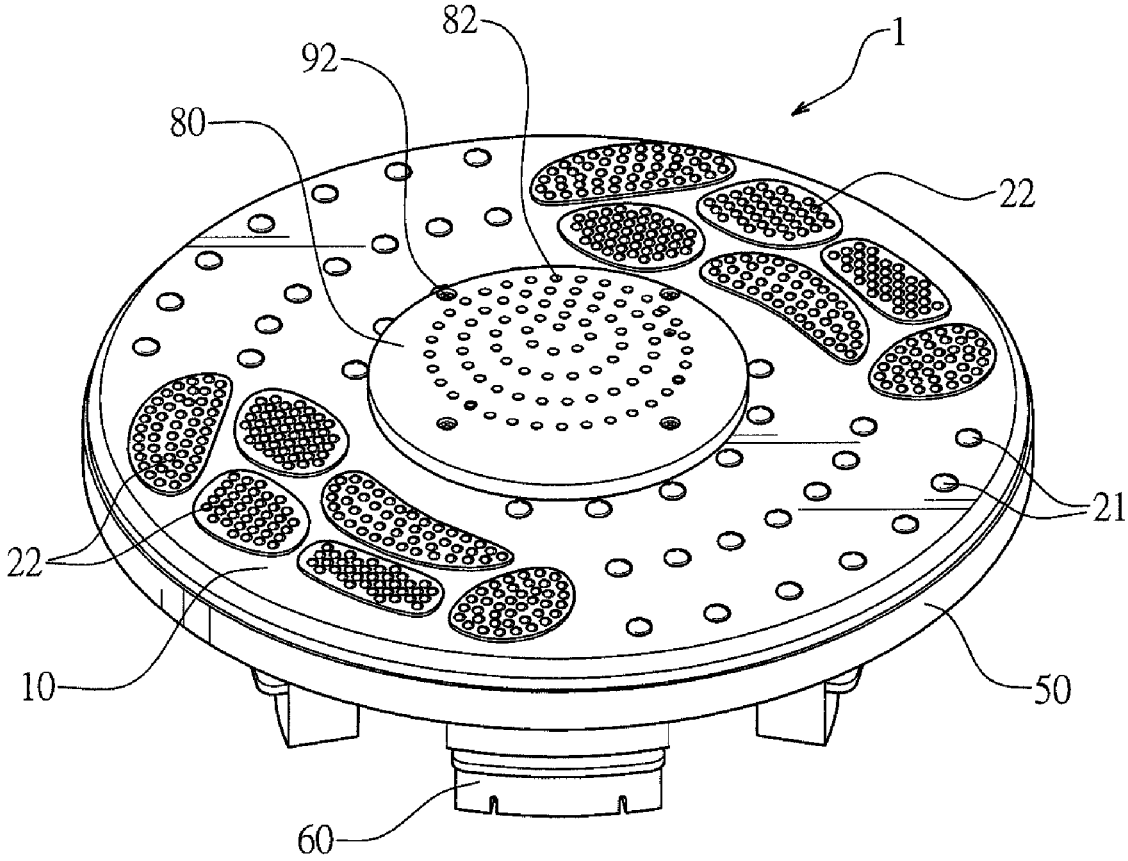
FIG. 1 is a perspective view of a waist twister in accordance with the preferred embodiment of the present invention.
Figure 2:
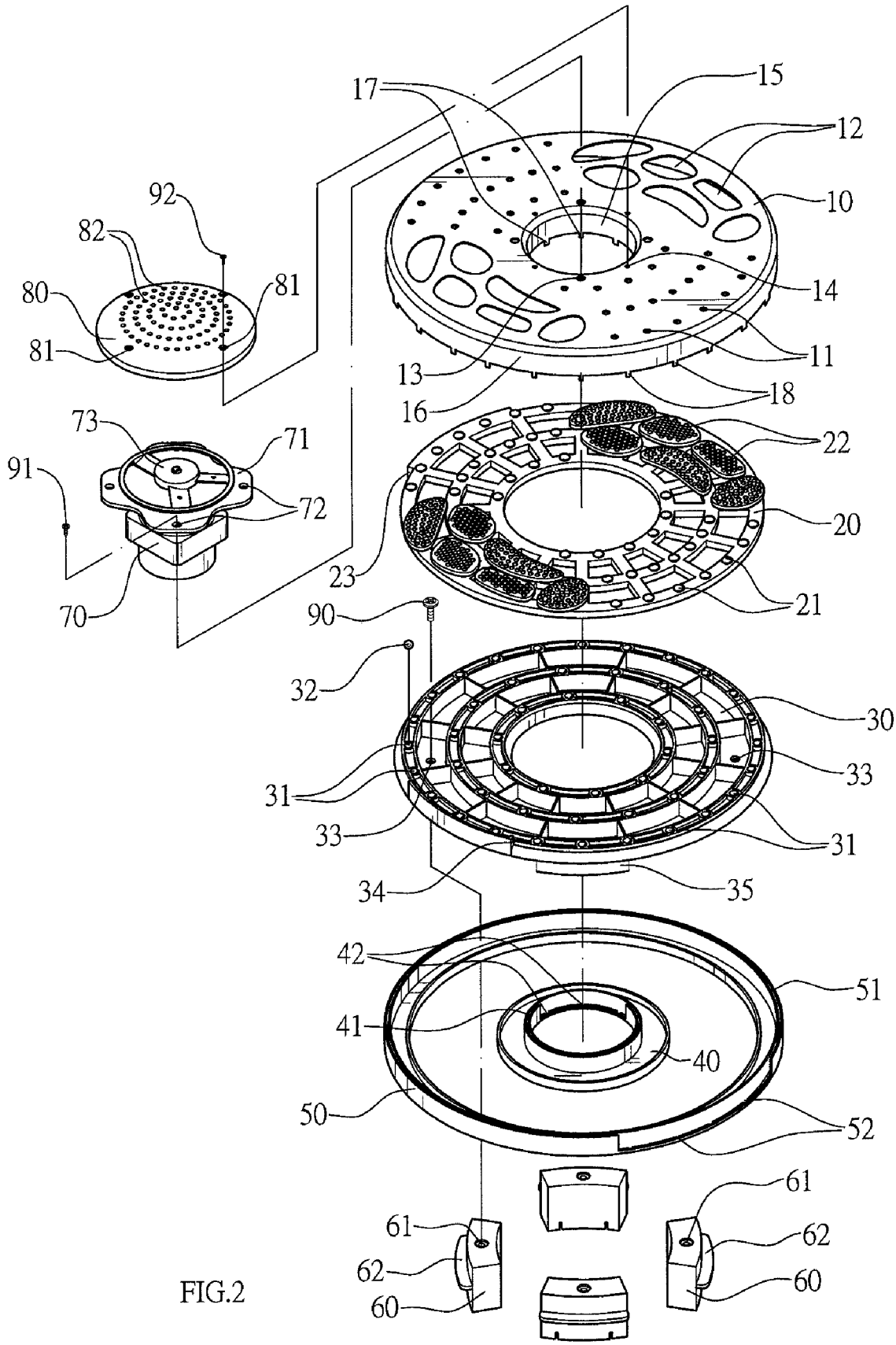
FIG. 2 is an exploded perspective view of the waist twister as shown in FIG. 1.

Referring to the drawings and initially to FIGS. 1-6, a waist twister 1 in accordance with the preferred embodiment of the present invention comprises a base disk 30, a plurality of support pads 60 mounted on a bottom of the base disk 30, a rotation disk 20 rotatably mounted on a top of the base disk 30, a top disk 10 secured on a top of the rotation disk 20 to rotate in concert with the rotation disk 20, a drive motor 70 secured on the top disk 10 to rotate in concert with the top disk 10 and having a top provided with an impeller 73 which has an unevenly distributed weight on the drive motor 70, a top cover 80 secured on a top of the top disk 10 to cover the drive motor 70 and the impeller 73, an inner ring 40 mounted on an inner periphery of the top disk 10 and located between the top disk 10 and the base disk 30, and an outer ring 50 mounted on an outer periphery of the top disk 10 and located between the top disk 10 and the base disk 30.

The top disk 10 is combined with the rotation disk 20 and has a surface provided with a plurality of positioning holes 11, a plurality of positioning slots 12, a plurality of screw holes 13 and a plurality of screw bores 14. The inner periphery of the top disk 10 is provided with a downward extending inner extension 15 combined with the inner ring 40. The inner extension 15 of the top disk 10 has an annular shape and is provided with a plurality of downward extending inner locking ribs 17. The outer periphery of the top disk 10 is provided with a downward extending outer extension 16 combined with the outer ring 50. The outer extension 16 of the top disk 10 has an annular shape and is provided with a plurality of downward extending outer locking ribs 18.

The top of the base disk 30 is provided with a plurality of positioning bores 31. The bottom of the base disk 30 is provided with a plurality of receiving recesses 35 for mounting the support pads 60. The base disk 30 has a surface provided with a plurality of through holes 33 each aligning with and connected to a respective one of the receiving recesses 35. The base disk 30 has an outer periphery provided with a protruding limit portion 34.

Figure 5:
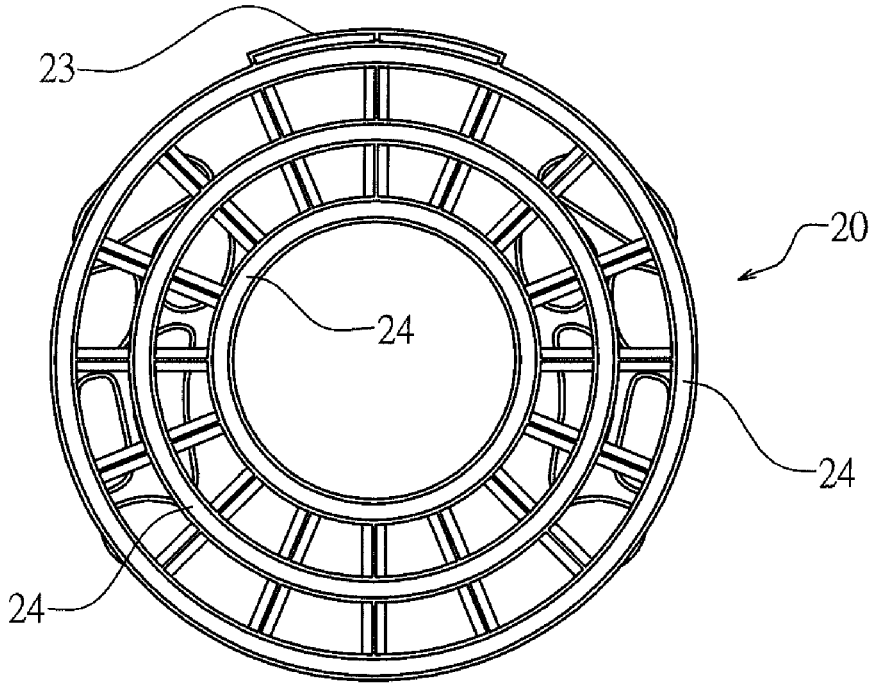
FIG. 5 is a bottom view of a rotation disk of the waist twister as shown in FIG. 2.
Figure 6:
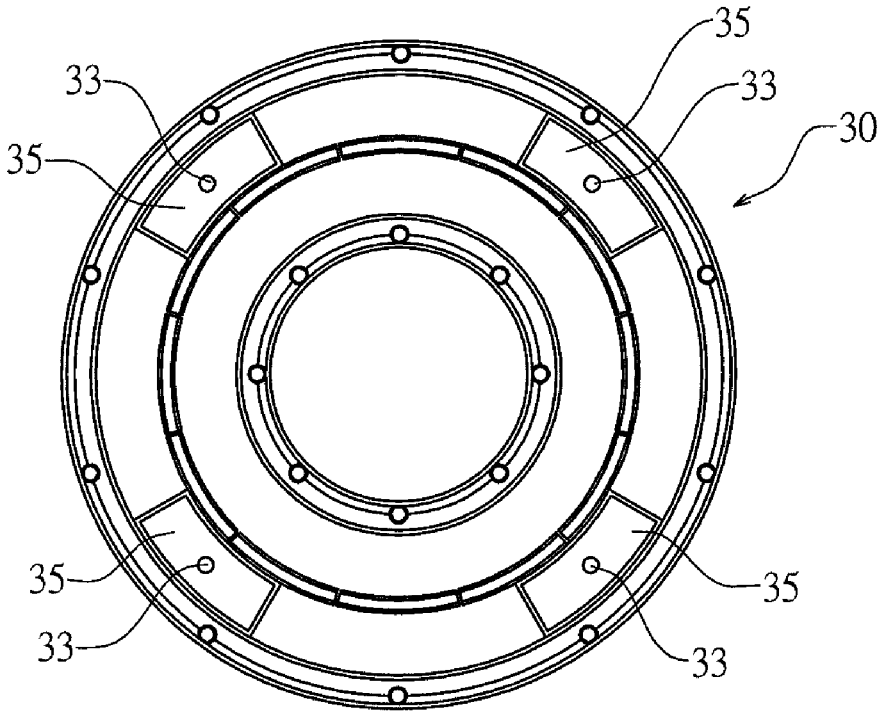
FIG. 6 is a bottom view of a base disk of the waist twister as shown in FIG. 2.

The rotation disk 20 is sandwiched between the top disk 10 and the base disk 30. The rotation disk 20 has a surface provided with a plurality of protruding massaging bosses 21 inserted through and protruding outwardly from the positioning holes 11 of the top disk 10 and a plurality of foot pads 22 inserted through and protruding outwardly from the positioning slots 12 of the top disk 10. The rotation disk 20 has an outer periphery provided with a protruding limit section 23 that is movable to abut the limit portion 34 of the base disk 30 to limit a further rotation of the rotation disk 20 relative to the base disk 30. The rotation disk 20 has a bottom provided with a plurality of annular slideways 24 (as shown in FIG. 5) aligning with the positioning bores 31 of the base disk 30, and the waist twister 1 further comprises a plurality of rolling balls 32 securely mounted in the positioning bores 31 of the base disk 30 and slidably mounted in the slideways 24 of the rotation disk 20 so that the rolling balls 32 are slidable and movable in the slideways 24 of the rotation disk 20 when the rotation disk 20 is rotatable relative to the base disk 30.

Each of the support pads 60 has a top provided with a threaded hole 61, and the waist twister 1 further comprises a plurality of locking screws 90 each extending through a respective one of the through holes 33 of the base disk 30 and each screwed into the threaded hole 61 of a respective one of the support pads 60 to combine the support pads 60 and the base disk 30 together. Each of the support pads 60 has a side provided with an elongate reinforcing strips 62.

The drive motor 70 is supported by a support bracket 71 which is secured on the top disk 10. The support bracket 71 extends through the top disk 10, the rotation disk 20 and the base disk 30, and the impeller 73 of the drive motor 70 protrudes outwardly from the support bracket 71 and the top disk 10 and faces the top cover 80. The support bracket 71 has a periphery provided with a plurality of through bores 72, and the waist twister 1 further comprises a plurality of locking screws 91 each extending through a respective one of the through bores 72 of the support bracket 71 and each screwed into a respective one of the screw holes 13 of the top disk 10 to combine the support bracket 71 and the top disk 10 together.

The top cover 80 has a periphery provided with a plurality of fixing holes 81, and the waist twister 1 further comprises a plurality of locking screws 92 each extending through a respective one of the fixing holes 81 of the top cover 80 and each screwed into a respective one of the screw bores 14 of the top disk 10 to combine the top cover 80 and the top disk 10 together. The top cover 80 has a surface provided with a plurality of ventilating holes 82 aligning with and connected to the impeller 73 of the drive motor 70 to introduce an air flow 93 produced by the impeller 73 of the drive motor 70 to flow outwardly from the top cover 80 and the top disk 10.

The inner ring 40 has an inner periphery provided with an annular fixing groove 41 to allow insertion of the inner extension 15 of the top disk 10. The fixing groove 41 of the inner ring 40 has a bottom provided with a plurality of fixing apertures 42 to allow insertion of the inner locking ribs 17 of the inner extension 15.

The outer ring 50 has an outer periphery provided with an annular retaining groove 51 to allow insertion of the outer extension 16 of the top disk 10. The retaining groove 51 of the outer ring 50 has a bottom provided with a plurality of retaining apertures 52 to allow insertion of the outer locking ribs 18 of the outer extension 16. Thus, the top disk 10, the rotation disk 20 and the base disk 30 are combined together by the inner ring 40 and the outer ring 50.

Figure 3:
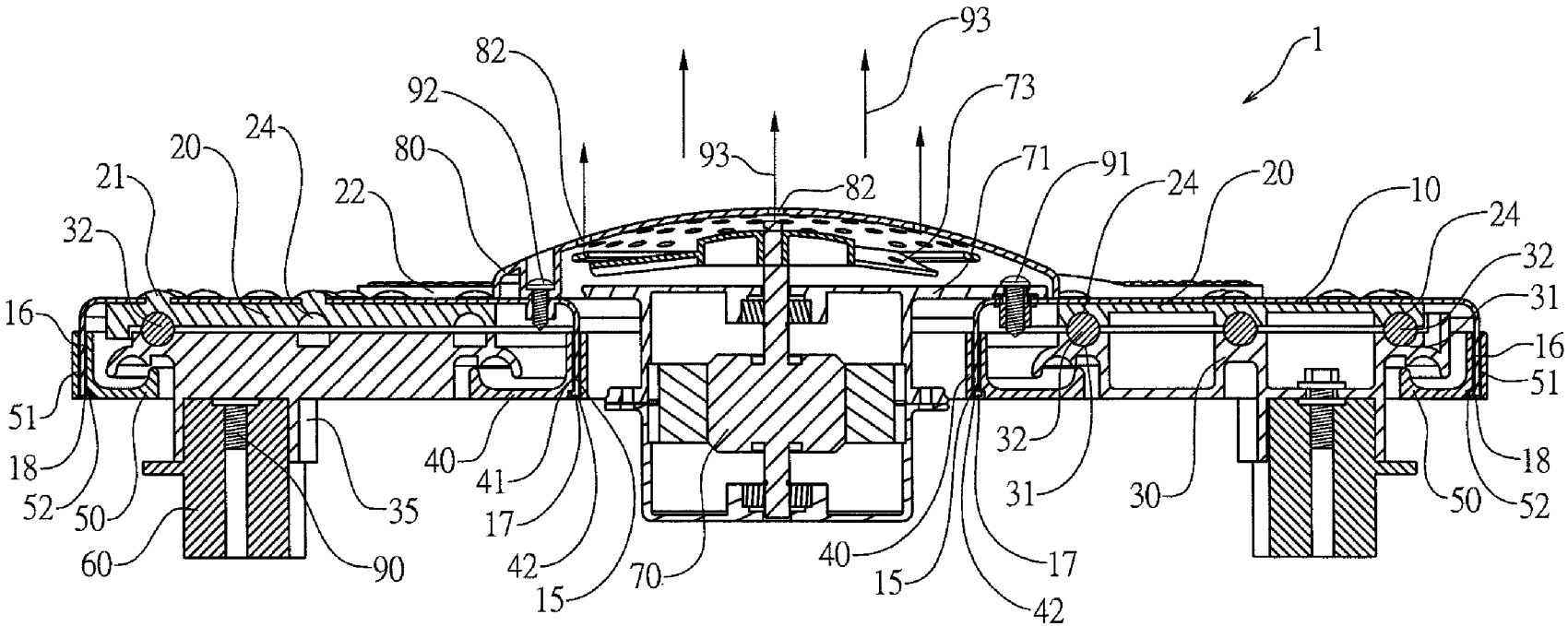
FIG. 3 is a front cross-sectional view of the waist twister as shown in FIG. 1.
Figure 4:
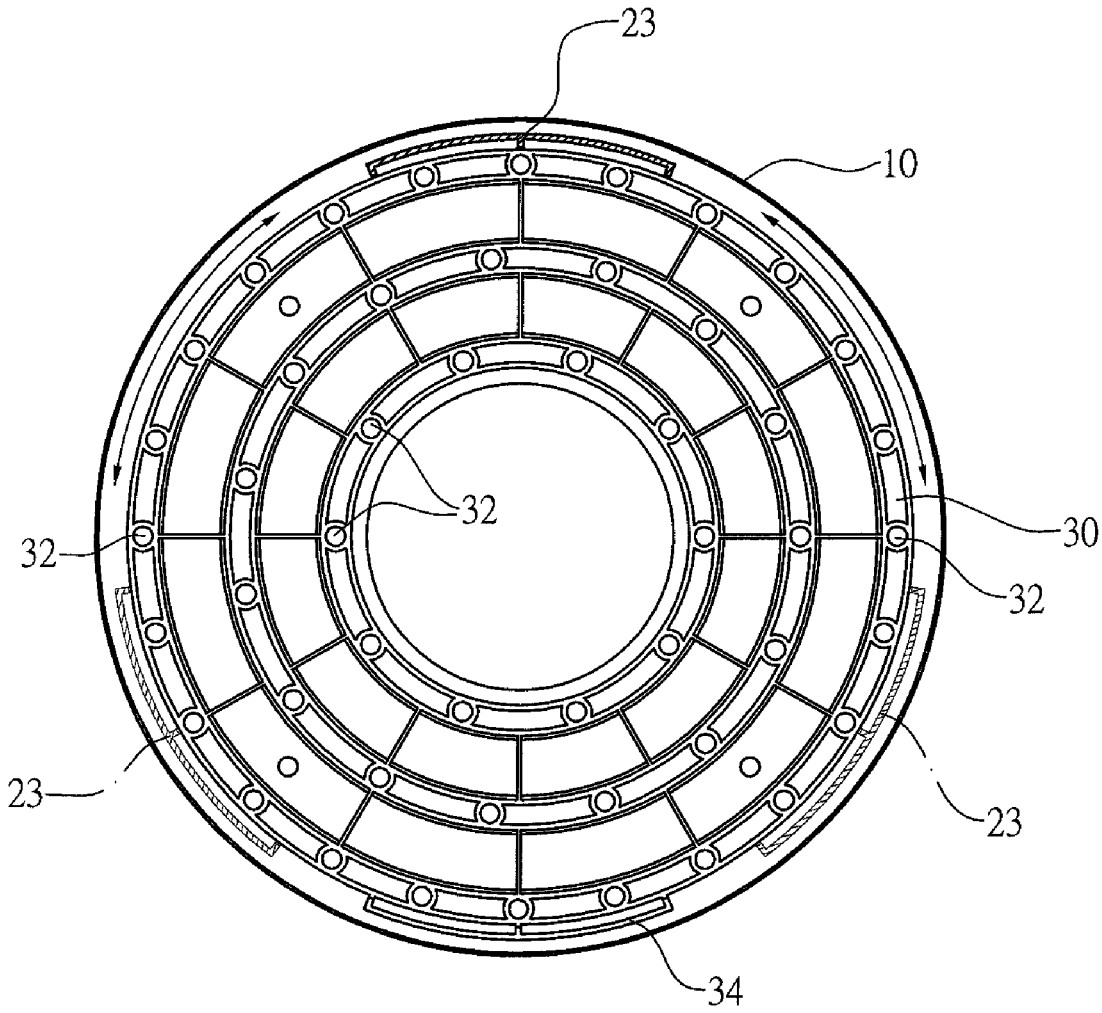
FIG. 4 is a schematic top cross-sectional operational view of the waist twister as shown in FIG. 2.
Figure 7:
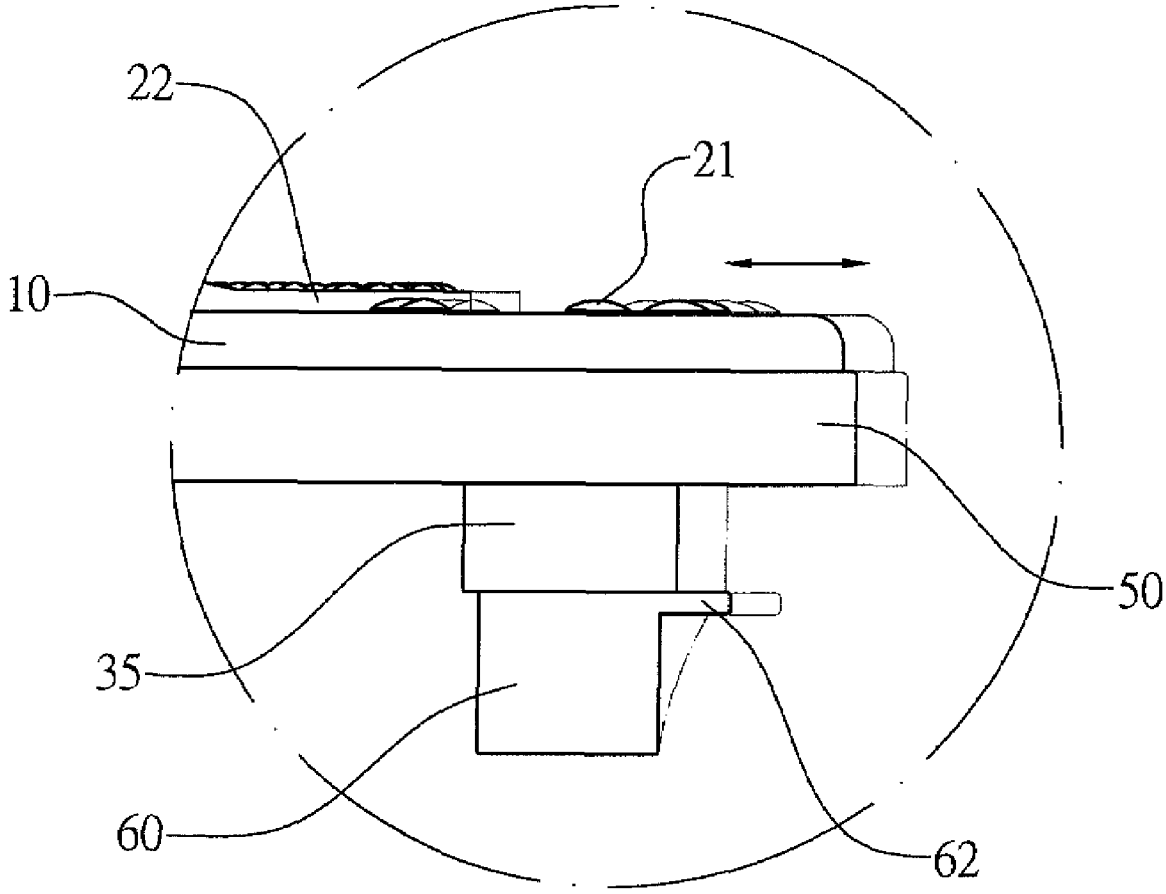
FIG. 7 is a partially front operational view of the waist twister as shown in FIG. 1.

In practice, referring to FIGS. 1-7, the base disk 30 is fixed by the support pads 60 and cannot be moved, the top disk 10 is secured on a top of the rotation disk 20, and the rolling balls 32 are slidable and movable in the slideways 24 of the rotation disk 20 when the rotation disk 20 is rotatable relative to the base disk 30. Thus, a user can stand on the top disk 10 to exert a rotating force on the top disk 10 to rotate the rotation disk 20 relative to the base disk 30 rightward and leftward so that the user's body can be swung and twisted so as to exercise the user's body. At this time, the limit section 23 of the rotation disk 20 is movable to abut the limit portion 34 of the base disk 30 to limit a further rotation of the rotation disk 20 relative to the base disk 30 so as to prevent the rotation disk 20 from being rotated relative to the base disk 30 excessively. In such a manner, the impeller 73 has an unevenly distributed weight on the drive motor 70, so that when the drive motor 70 is operated to rotate the impeller 73, the drive motor 70 produces a vibration to vibrate the top disk 10, the rotation disk 20 and the base disk 30 simultaneously as shown in FIG. 7 so as to provide a swaying function to the user standing on the top disk 10, thereby enhancing the exercising effect of the waist twister. In addition, the top cover 80 has a plurality of ventilating holes 82 connected to the impeller 73 of the drive motor 70 to introduce the air flow 93 produced by the impeller 73 of the drive motor 70 to flow outwardly from the top cover 80 and the top disk 10 as shown in FIG. 3 so as to provide a heat dissipation effect to the user standing on the top disk 10, thereby providing a comfortable sensation to the user. Further, each of the support pads 60 is made of a soft material to isolate the base disk 30 from the ground so that the vibration produced by the drive motor 70 is limited to the top disk 10, the rotation disk 20 and the base disk 30 only.

Accordingly, the impeller 73 has an unevenly distributed weight on the drive motor 70, so that when the drive motor 70 is operated to rotate the impeller 73, the drive motor 70 produces a vibration to vibrate the top disk 10, the rotation disk 20 and the base disk 30 simultaneously so as to provide a swaying function to the user standing on the top disk 10, thereby enhancing the exercising effect of the waist twister. In addition, the top cover 80 has a plurality of ventilating holes 82 connected to the impeller 73 of the drive motor 70 to introduce the air flow 93 produced by the impeller 73 of the drive motor 70 to flow outwardly from the top cover 80 and the top disk 10 so as to provide a heat dissipation effect to the user standing on the top disk 10, thereby providing a comfortable sensation to the user. Further, each of the support pads 60 is made of a soft material to isolate the base disk 30 from the ground so that the vibration produced by the drive motor 70 is limited to the top disk 10, the rotation disk 20 and the base disk 30 only.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A waist twister for a user to stand on, comprising:

a base disk;

a rotation disk rotatably mounted on a top of the base disk;

a top disk secured on a top of the rotation disk to rotate in concert with the rotation disk;

a drive motor secured on the top disk to rotate in concert with the top disk and having a top provided with an impeller which has an unevenly distributed weight on the drive motor;

a top cover secured on a top of the top disk to cover the drive motor and the impeller;

wherein the top cover has a surface provided with a plurality of ventilating holes aligning with and connected to the impeller of the drive motor to introduce an air flow produced by the impeller of the drive motor to flow outwardly from the top cover and the top disk.

2. The waist twister of claim 1, wherein the top of the base disk is provided with a plurality of positioning bores;

the rotation disk has a bottom provided with a plurality of annular slideways aligning with the positioning bores of the base disk;

the waist twister further comprises a plurality of rolling balls securely mounted in the positioning bores of the base disk and slidably mounted in the slideways of the rotation disk.

3. The waist twister of claim 2, wherein the rolling balls are slidable and movable in the slideways of the rotation disk when the rotation disk is rotatable relative to the base disk.

4. A waist twister for a user to stand on, comprising:

a base disk;

a rotation disk rotatable mounted on a top of the base disk;

a top disk secured on a top of the rotation disk to rotate in concert with the rotation disk;

a drive motor secured on the top disk to rotate in concert with the top disk and having a top provided with an impeller which has an unevenly distributed weight on the drive motor;

a top cover secured on a top of the top disk to cover the drive motor and the impeller;

wherein the base disk has an outer periphery provided with a protruding limit portion;

the rotation disk has an outer periphery provided with a protruding limit section that is movable to abut the limit portion of the base disk to limit a further rotation of the rotation disk relative to the base disk.

5. The waist twister of claim 1, wherein the top disk has a surface provided with a plurality of positioning holes;

the rotation disk has a surface provided with a plurality of protruding massaging bosses inserted through and protruding outwardly from the positioning holes of the top disk.

6. A waist twister for a user to stand on, comprising:

a base disk;

a rotation disk rotatably mounted on a top of the base disk;

a top disk secured on a top of the rotation disk to rotate in concert with the rotation disk;

a drive motor secured on the top disk to rotate in concert with the top disk and having a top provided with an impeller which has an unevenly distributed weight on the drive motor;

a top cover secured on a top of the top disk to cover the drive motor and the impeller;

wherein the top disk has a surface provided with a plurality of positioning slots;

the rotation disk has a surface provided with a plurality of foot pads inserted through and protruding outwardly from the positioning slots of the top disk.

7. The waist twister of claim 1, wherein the drive motor is supported by a support bracket which is secured on the top disk.

8. The waist twister of claim 7, wherein the top disk has a surface provided with a plurality of screw holes;

the support bracket has a periphery provided with a plurality of through bores;

the waist twister further comprises a plurality of locking screws each extending through a respective one of the through bores of the support bracket and each screwed into a respective one of the screw holes of the top disk to combine the support bracket and the top disk together.

9. The waist twister of claim 7, wherein the support bracket extends through the top disk, the rotation disk and the base disk;

the impeller of the drive motor protrudes outwardly from the support bracket and the top disk and faces the top cover.

10. The waist twister of claim 1, wherein the top disk has a surface provided with a plurality of screw bores;

the top cover has a periphery provided with a plurality of fixing holes;

the waist twister further comprises a plurality of locking screws each extending through a respective one of the fixing holes of the top cover and each screwed into a respective one of the screw bores of the top disk to combine the top cover and the top disk together.

11. The waist twister of claim 1, further comprising:

a plurality of support pads mounted on a bottom of the base disk.

12. The waist twister of claim 11, wherein the bottom of the base disk is provided with a plurality of receiving recesses for mounting the support pads.

13. The waist twister of claim 12, wherein the base disk has a surface provided with a plurality of through holes each aligning with and connected to a respective one of the receiving recesses;

each of the support pads has a top provided with a threaded hole;

the waist twister further comprises a plurality of locking screws each extending through a respective one of the through holes of the base disk and each screwed into the threaded hole of a respective one of the support pads to combine the support pads and the base disk together.

14. The waist twister of claim 11, wherein each of the support pads has a side provided with an elongate reinforcing strips.

15. The waist twister of claim 1, further comprising:

an inner ring mounted on an inner periphery of the top disk and located between the top disk and the base disk;

an outer ring mounted on an outer periphery of the top disk and located between the top disk and the base disk.

16. The waist twister of claim 15, wherein the inner periphery of the top disk is provided with a downward extending inner extension combined with the inner ring;

the inner extension of the top disk has an annular shape and is provided with a plurality of downward extending inner locking ribs;

the outer periphery of the top disk is provided with a downward extending outer extension combined with the outer ring;

the outer extension of the top disk has an annular shape and is provided with a plurality of downward extending outer locking ribs;

the inner ring has an inner periphery provided with an annular fixing groove to allow insertion of the inner extension of the top disk;

the fixing groove of the inner ring has a bottom provided with a plurality of fixing apertures to allow insertion of the inner locking ribs of the inner extension;

the outer ring has an outer periphery provided with an annular retaining groove to allow insertion of the outer extension of the top disk;

the retaining groove of the outer ring has a bottom provided with a plurality of retaining apertures to allow insertion of the outer locking ribs of the outer extension.

17. The waist twister of claim 15, wherein the top disk, the rotation disk and the base disk are combined together by the inner ring and the outer ring.

18. The waist twister of claim 1, wherein the impeller has an unevenly distributed weight on the drive motor, so that when the drive motor is operated to rotate the impeller, the drive motor produces a vibration to vibrate the top disk, the rotation disk and the base disk simultaneously so as to provide a swaying function.

19. The waist twister of claim 1, wherein the top disk is combined with the rotation disk;

the rotation disk is sandwiched between the top disk and the base disk.

* * * * *